US008226425B2

(12) United States Patent
Chien et al.

(10) Patent No.: US 8,226,425 B2
(45) Date of Patent: Jul. 24, 2012

(54) SPARKLESS ELECTRICAL CONNECTOR

(75) Inventors: Shen-Yuan Chien, Taipei (TW); Meng-Chang Liu, Puli Township (TW)

(73) Assignee: American Power Conversion Corporation, West Kingston, RI (US)

( * ) Notice: Subject to any disclaimer, the term of this patent is extended or adjusted under 35 U.S.C. 154(b) by 0 days.

(21) Appl. No.: 12/533,595

(22) Filed: Jul. 31, 2009

(65) Prior Publication Data

US 2011/0028012 A1 Feb. 3, 2011

(51) Int. Cl.
*H01R 13/53* (2006.01)

(52) U.S. Cl. ..... 439/181; 438/620.21

(58) Field of Classification Search ..... 439/181, 439/620.21, 620.08

See application file for complete search history.

(56) References Cited

U.S. PATENT DOCUMENTS

| | | | | |
|---|---|---|---|---|
| 6,935,879 | B2 * | 8/2005 | Whitney et al. | 439/181 |
| 2001/0024895 | A1 * | 9/2001 | Sakiyama et al. | 439/181 |
| 2002/0064986 | A1 * | 5/2002 | Hirai et al. | 439/181 |
| 2003/0176093 | A1 * | 9/2003 | Ota et al. | 439/181 |
| 2004/0137772 | A1 * | 7/2004 | Ota et al. | 439/181 |
| 2008/0311773 | A1 * | 12/2008 | Smadi et al. | 439/181 |

FOREIGN PATENT DOCUMENTS

EP 1 703 597 A1 9/2006

OTHER PUBLICATIONS

International Search Report and Written Opinion, PCT/US2010/043541, mailing date Dec. 8, 2010.

Notification Concerning Transmittal of International Preliminary Report on Patentability and International Preliminary Report on Patentability in International Application No. PCT/US2010/043541, 7 pages, mailed Feb. 9, 2012.

* cited by examiner

*Primary Examiner* — Hien Vu

(74) *Attorney, Agent, or Firm* — Hamilton, Brook, Smith & Reynolds, P.C.

(57) ABSTRACT

Methods and apparatuses supporting an electrical connection in a manner that eliminates or reduces a danger of electrical sparking are disclosed. A sparkless electrical connector has a conductor, configured to provide flow of electricity between an electrical source and a load, and a resistive element, operatively coupled to the conductor, to resist flow of electricity during a state of partial connection with the electrical source or the load. The resistive element may be not in contact with a terminal of the source or load during a state of full connection. The resistive element may be a coating of an anodized material on a pin of the conductor. The coating provides a resistance sufficient to prevent sparking during connection of the conductor and at least one of the electrical source and the load. Techniques disclosed herein benefit users and manufacturers in the areas of safety, cost, simplicity, and reliability.

7 Claims, 7 Drawing Sheets

SPARKLESS ELECTRICAL CONNECTOR

BACKGROUND OF THE INVENTION

An electrical connector may be used to provide passage of electricity via a conductor (e.g., a wire) from an electrical source to a load. When providing a connection between an electrical source and a load, an electrical spark may result at initial contact between the connector and either the source or the load due to high current. Such a spark may be dangerous to a user of the connector.

SUMMARY OF THE INVENTION

An embodiment of the invention is an electrical connector having a conductor and a resistive element. The electrical conductor is configured to provide flow of electricity between an electrical source and a load. The resistive element is operatively coupled to the conductor and resists the flow of electricity during a state in which the connector is at least partially connected to the electrical source or the load.

The electrical connector may further include a first pin, configured to couple electrically with the electrical source, and a second pin, configured to couple electrically with the load and the first pin. The resistive element is operatively coupled to at least one of the pins.

The electrical connector may define a receptacle having first and second contact connectors of the conductor in it. The first and second contact connectors may be configured to couple electrically with the electrical source and the load, respectively. The resistive element may be operatively coupled to at least one of the contact connectors.

In an embodiment, the resistive element is not in contact with a terminal of the electrical source or the load during a state in which the connector is fully connected to the electrical source or the load.

The resistive element may be a coating, e.g., of an anodized material, on a pin of the conductor. The coating provides a resistance sufficient to prevent sparking during connection of the conductor and at least one of the electrical source and the load.

The conductor may include a busbar and at least two interface components, and the resistive element may be operatively coupled to at least one of the interface components.

The coating may be at a distal half of the pin and may cover a distal tip of the pin.

The electrical source may be a battery.

The electrical connector may be a finger contact of a printed circuit board, a battery pole connector configured to connect with an uninterruptible power supply, or an electrical plug.

Another embodiment is a method of supporting an electrical connection. The method includes passing electricity from an electrical source, through a conductor of an electrical connector, to a load, and resisting flow of electricity at the electrical connector during a state in which the electrical connector is at least partially connected to the electrical source or the load.

The method of claim 12 may further include supporting normal flow of electricity at the electrical connector during a state in which the electrical connector is fully connected to the electrical source or the load.

Resisting the flow of electricity may include providing an anodized coating on the connector to contact a terminal of the electrical source or the load. The coating provides a resistance sufficient to prevent sparking during connection of the conductor and at least one of the electrical source and the load.

Another embodiment is an apparatus having means for passing electricity from an electrical source, through a conductor of an electrical connector, to a load. The apparatus also has means for resisting flow of electricity at the electrical connector during a state in which the electrical connector is at least partially connected to the electrical source or the load.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

DETAILED DESCRIPTION OF THE INVENTION

A description of example embodiments of the invention follows.

Figure 1:
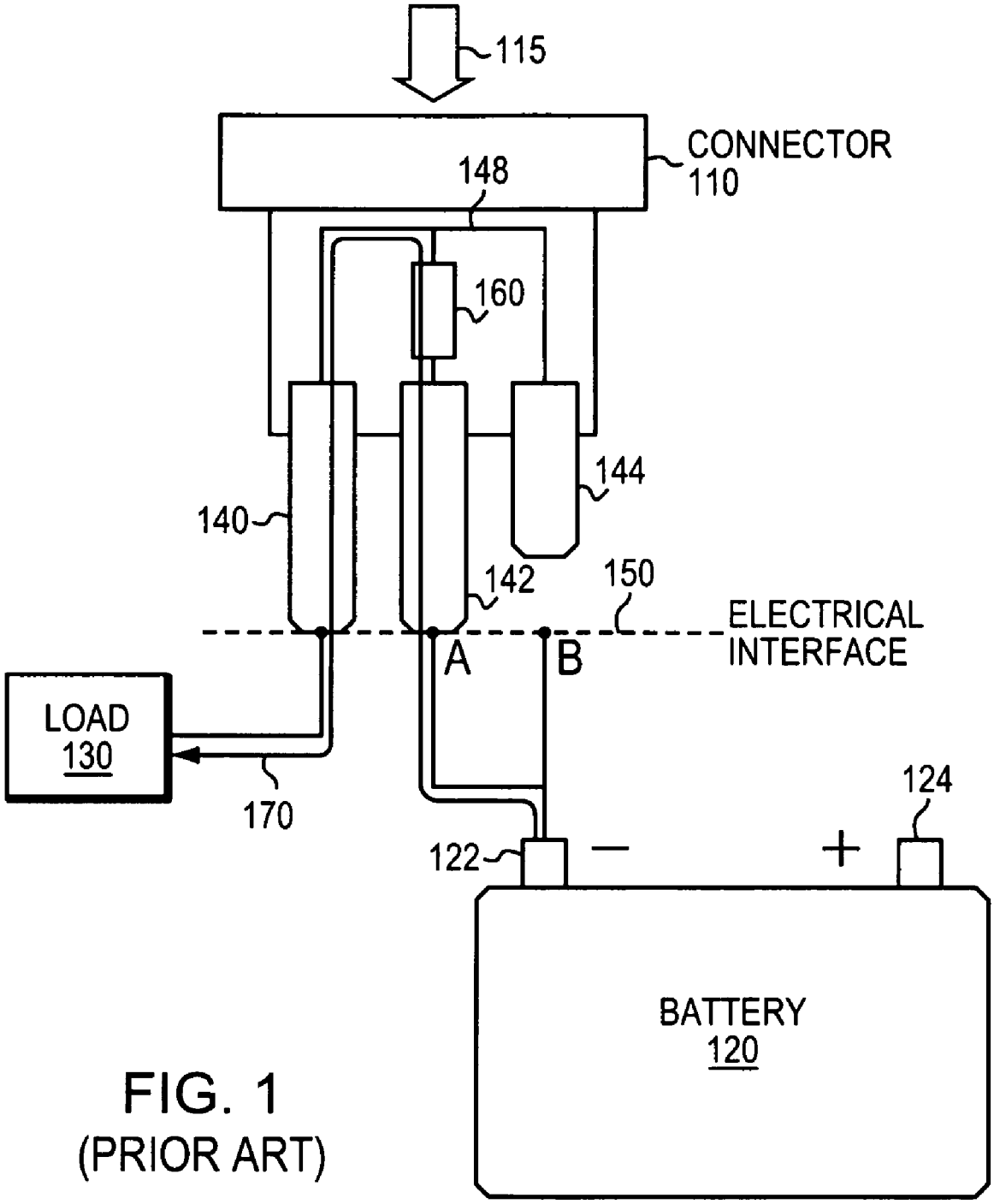
FIG. 1 (PRIOR ART)
FIG. 1 is a schematic diagram of an electrical system including source, load, and prior art sparkless connector electrically therebetween.

FIG. 1 shows a prior art sparkless battery (electrical) connector 110. The connector 110 is configured to provide an electrical pathway between a negative terminal 122 of an electrical source 120 (e.g., a battery) and a load 130. A connection at the positive terminal 124 of the electrical source is not shown for simplicity but is assumed. The connector 110 includes three pins 140, 142, and 144, a high impedance resistor 160, and wiring 148 (or other conductive element) as shown in FIG. 1. As the connector 110 is moved in the direction indicated by the arrow 115 to cause the ends of pins 140 and 142 to contact with point A at the level of electrical interface 150 shown by a dashed line, electrical coupling is achieved at point A, e.g., between terminals of the connector and the battery. In other words, an electrical coupling results from the connection. As used herein, the terms "connect" or "connection" refer to the physical (mechanical) process of engaging (e.g., via insertion) a first component (e.g., connector 110) with a second component (e.g., electrical source 120) to couple the components electrically. An electrical path is formed from the battery 120 through a first source-side pin 142, resistor 160, wiring 148, load-side pin 140, and to the load 130, as indicated by arrow 170.

The resistor 160 may be a positive temperature coefficient (PTC) resistor that provides high impedance in response to heat, e.g., due to high current. Current flows along the path indicated by arrow 170 when the connector 110 is partially connected (during a state in which the connector 110 is partially engaged) relative to the electrical interface 150 indicating contact between terminals. During this state, the resistor 160 provides high impedance to current flow, thereby limiting current and preventing (or mitigating) a spark upon initial contact.

When the connector 110 is fully connected due to further motion along the arrow 115, a second source-side pin 144 contacts a terminal of the battery at point B (this state is not shown in FIG. 1). In such a full connection state, electrical current seeks a path through the second source-side pin 144 to the load pin 140 and to the load 130, i.e., bypassing the first source-side pin 142 and resistor 160 and thereby providing normal electrical conduction (i.e., without additional resistance) with wiring 148.

The prior art connector 110 has a complex structure that results in high cost and makes production of the device relatively difficult.

Figure 2B:
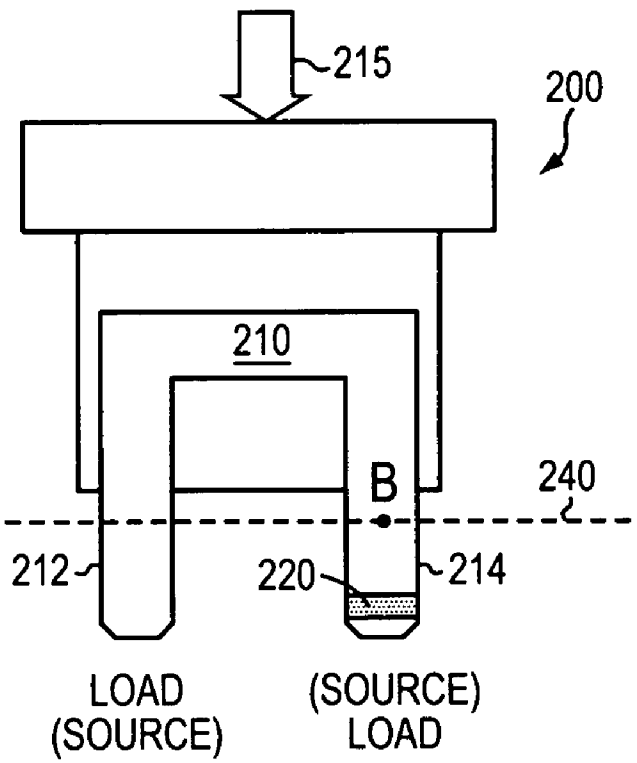
FIGS. 2A-B are front views of a connector according to an embodiment of the invention during states of partial and full engagement, respectively.
Figure 2A:
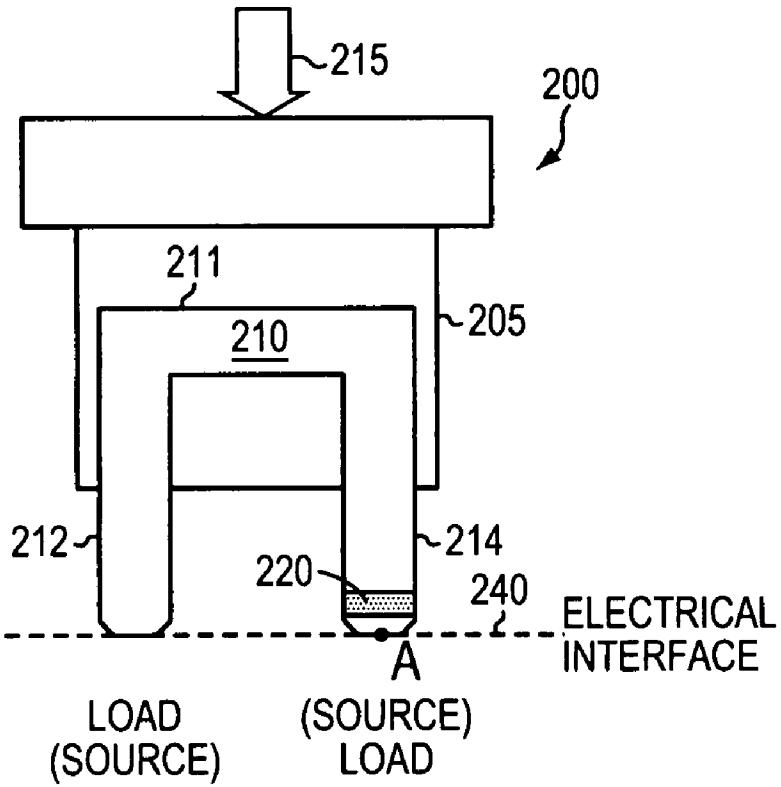

FIG. 2A is a front view of a connector 200 according to an embodiment of the invention that addresses the foregoing deficiencies of the prior art sparkless connector of FIG. 1. The connector 200 is simpler, has fewer parts, is easier to manufacture and produce, and is less prone to failure than the prior art connector 110, as will be discussed below. The connector 200 has a conductor 210, shown with two pins 212 and 214 that are configured to couple electrically with terminals of an electrical source (e.g., a battery) and a load (source and load not shown) at contact points indicated by dashed line 240 (i.e., the dashed line 240 represents the location of terminals to be connected to the connector 200). In different embodiments, the first or the second pin couples electrically with the electrical source. In other embodiments, other numbers of pins, e.g., one pin or more than two pins, are used, as discussed later below. Depending on an orientation of the connector 200 during coupling with a source and load, the first pin 212 may be referred to as a source-side pin 212 and the second pin 214 may be referred to as a load-side pin, or vice-versa. Unless specifically described otherwise, orientation of the connector 200 does not limit the scope of example embodiments disclosed herein.

The connector 200 is shown in FIG. 2A in a state of partial connection (e.g., partial electrical coupling with an electrical source and/or load), as illustrated pins 212 and 214 initially making contact with an electrical interface 240 of source/load terminals, as indicated by a dashed line. The connector 200 is connected in a direction indicated by an arrow 215 to reach this state of partial connection. Pin 214 makes contact with terminals of either the electrical source or the load (in different embodiments) at point A. The connector 200 passes electricity from an electrical source (or load) connected to pin 214, through a conductor 210, to a load (or electrical source) connected to pin 212. Although the conductor/pin assembly is shown in FIG. 2A as an integral unit, with a crossbar 211 that conducts electricity, the pins 212 and 214 may be separate from (but operatively connected to) a conductor connecting them in another embodiment. In an embodiment, the pins 212, 214 and/or the crossbar 211 are situated in a connector housing 205 that is part of the connector 200. The crossbar 211 may be at a proximal end of the pins 212, 214.

A resistive element 220, operatively coupled to a distal half of pin 214 relative to the connector housing 205, resists flow of electricity via the connector during the state in which the connector 200 is at least partially connected to the electrical source or the load (possibly both), as in FIG. 2A. The resistive element 220 provides high impedance to the flow of electricity due to contact between the resistive element 220 and terminal(s) of the electrical source (or load) at point A. The resistive element 220 provides sufficient resistance to prevent (or reduce a chance of) sparking by limiting current drawn during initial connection of the connector 200 with the electrical source or load (possibly both). In some embodiments, resistive elements 220 are operatively coupled to both the pins 212, 214. Further details about the resistive element 220 are provided below in the context of FIG. 2C.

FIG. 2B is a front view of the connector 200 in a state of full connection (or at least, in another embodiment, further connection than the partial connection of FIG. 2A). The full (or further than partial) connection results from further motion of the connector 200 (relative to FIG. 2A) along the direction of the arrow 215. During the state of full connection (e.g., full insertion of the connector 200 into a structure configured to received the connector 200), contact between the connector 200 and terminals of the electrical source 214 and load 212 occurs at the electrical interface 240 (shown as a dashed line), i.e., at point B with respect to pin 214. Since the resistive element 220 is no longer in sole contact with a terminal of the electrical source 214 (or load 212) (i.e., a more conductive surface area of the pin 214 is (also) in contact with a terminal), normal conduction of electricity occurs from the first pin 214, through the conductor 210, to the second pin 212. In other words, the current is not limited by the resistive element 220 during the state of full connection shown in FIG. 2B. Such restriction on current flow is not necessary, since there is no longer a danger of sparking (since the sparking occurs on initial contact/connection, which does not apply to the state shown in FIG. 2B).

Figure 2C:
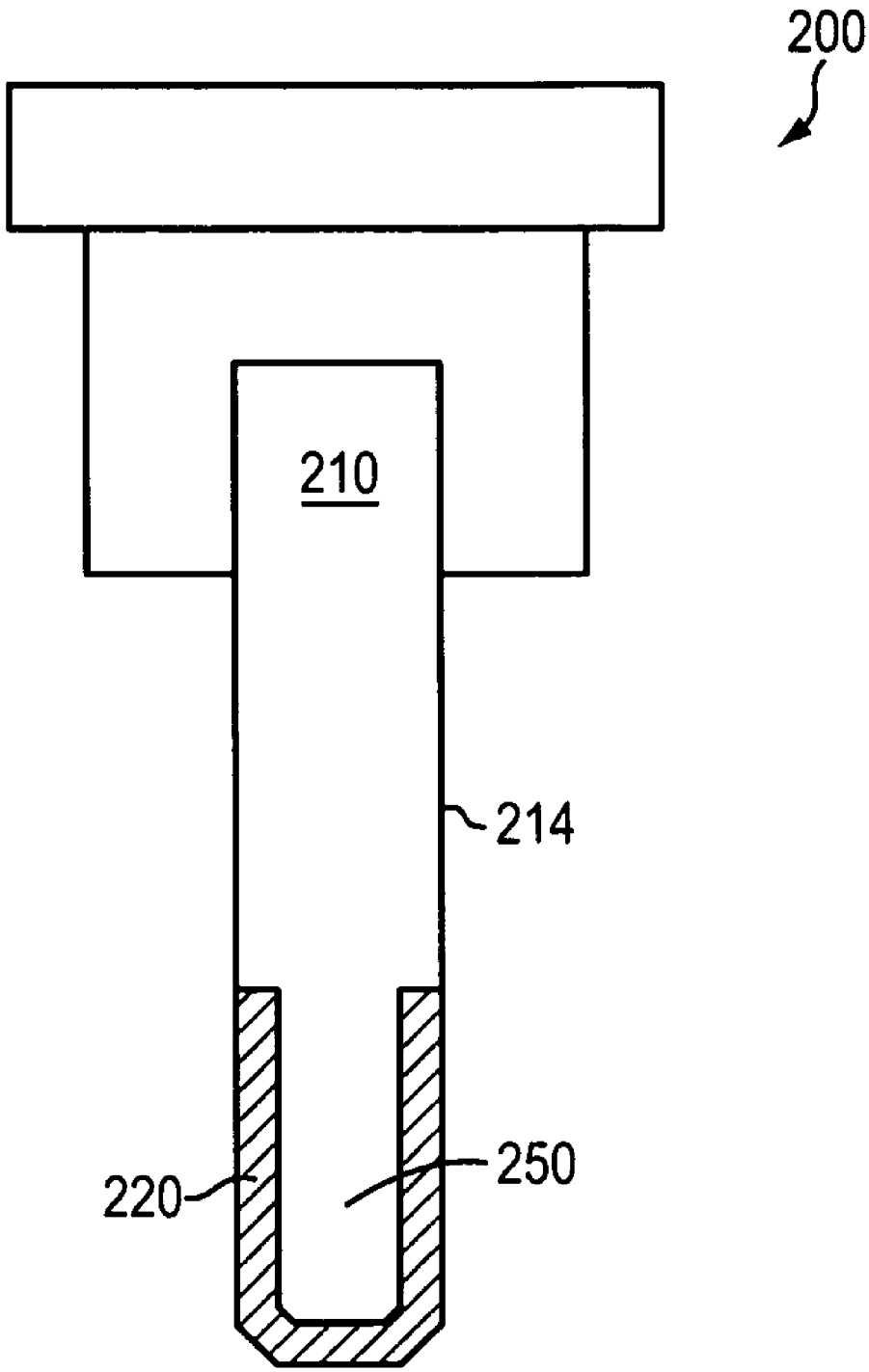
FIG. 2C is a side view of a connector according to an embodiment of the invention.

FIG. 2C is a side view of the connector 200 according to an embodiment of the invention. In FIG. 2C, an edge of pin 214 (FIGS. 2A-B) is facing out of the page. The resistive element 220 is shown to cover a distal tip 250 of pin 214 in this embodiment. The resistive element 220 is provided, in an embodiment, as a coating utilizing an anodized material, i.e., having a surface layer of oxide formed via an electrolytic process. The partial surface covering as in FIG. 2C is a low cost option (e.g., lower cost than providing a separate resistor as in a prior art sparkless battery connector).

By providing high impedance via a resistive element as in FIGS. 2A-C (e.g., as a coating in FIG. 2C), the presently disclosed connector 200 is simpler (e.g., has fewer parts), less expensive than the prior art sparkless connector, has a lower failure rate than a resistor that carries full current compared to the resistive element that spreads current over its contacting surface area with the mating socket (or pin in an alternative gender embodiment), and is easier to manufacture.

Although the resistive element 220 is illustrated in FIGS. 2A-C and described as being a surface layer of oxide, it should be understood that the resistive element may take on any form, such as a carbon sleeve, coating, impregnation, or other form of coupling or associating the resistive element 220 to its pin. Further, although the term "element" is used, it should be understood that the element need not be a separate mechanical "thing" from the pin, such as in the case of a surface layer of oxide.

Figure 3A:
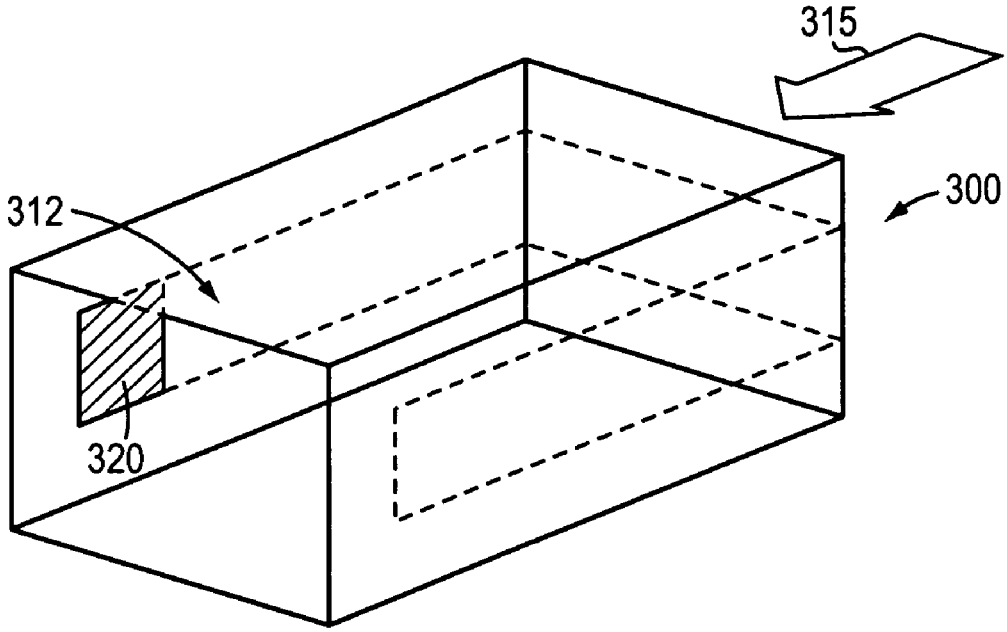
FIG. 3A is an isometric view of a connector according to another embodiment of the invention.

FIG. 3A is an isometric view of an electrical connector 300 according to another embodiment of the invention. The connector 300 defines a receptacle having a first contact connector 312 and a second contact connector (not labeled in FIG. 3A, but shown with dashed lines) on opposite inside faces of the receptacle (i.e., facing each other). The contact connectors are similar in functionality to the pins 212, 214 discussed above in terms of providing an electrical contact point (connection) between a conductor (of the connector 300) and terminals of an electrical source and a load (not shown). As with the pins 212, 214, either contact connector may be in contact with the source or load. A resistive element 320 is operatively coupled to at least one of the contact connectors (and possibly both). The resistive element 320 may be a resistive coating that partially covers at least one of the contact connectors, e.g., contact connector 312 as in FIG. 3A. The resistive element 320 may be configured to contact the electrical source or the load in different embodiments.

As the connector 300 is moved in the direction indicated by an arrow 315, initial electrical connection occurs at a contact point (i.e., surface area) corresponding to the resistive element 320 (partial engagement). Sparking is reduced or eliminated at the initial contact point due to high impedance, provided by the resistive element 320, that limits current flow. As the connector is moved further to full engagement, electrical flow bypasses the resistive element 320, since the resistive element 320 is no longer the only point of contact between the contact connector 312 and the source/load, and normal conduction of electricity ensues.

Figure 3B:
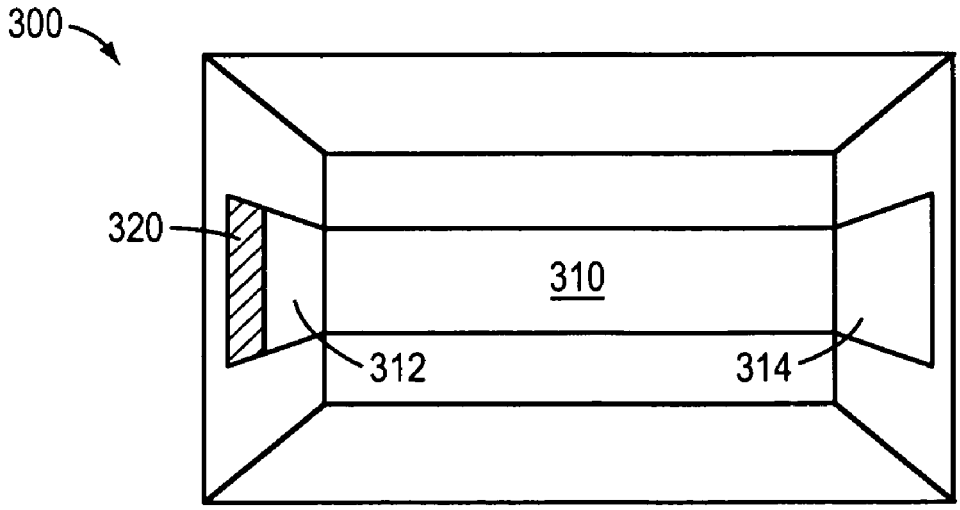
FIG. 3B is a perspective view looking into the connector of FIG. 3A.

FIG. 3B is a perspective view looking into the connector of FIG. 3A. The conductor 310 is shown along a back wall (face) of the receptacle, and contact connectors 312, 314 are shown on opposite inside faces.

It should be understood that alternative configurations for the receptacle may be used as well. For example, the receptacle may define separate cavities for terminals corresponding to the electrical source and the load, respectively, depending on particular implementation details (see, for example, FIG. 3C, discussed below). Such implementation details are well known to one of ordinary skill in the art. Similarly, the receptacle may have a different shape from the box-like shape of FIGS. 3A-B. Although the conductor 310 is shown as an integral unit having contact connectors 312, 314 at opposing ends, the contact connectors may be separate (and electrically connected via the conductor 310) in other embodiments, e.g., using other wiring configurations (not shown).

Figure 4B:
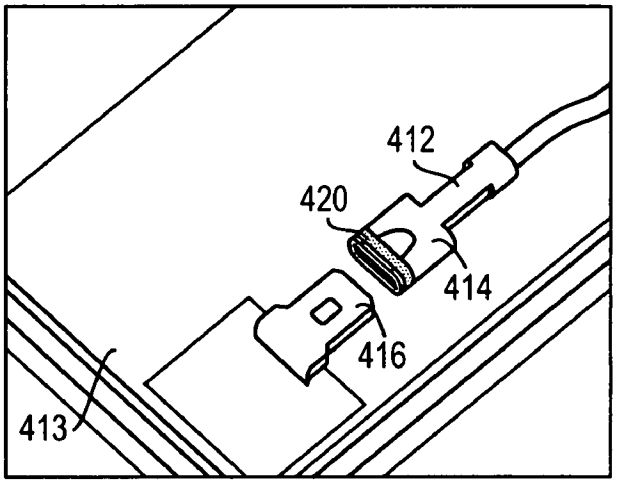
FIGS. 4A-D are views of an electrical connector implemented as a finger contact of a printed circuit board, a battery pole connector configured to connect with an uninterruptible power supply, an electrical plug, and a busbar connector respectively, according to embodiments of the invention.
Figure 4A:
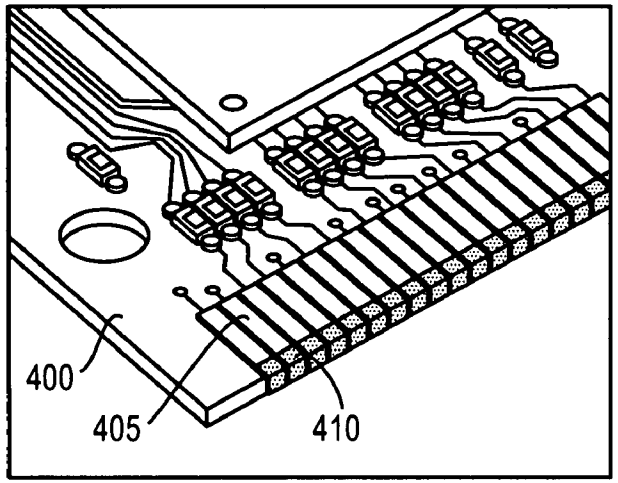

FIG. 4A is a view of an electrical connector implemented as a finger contact 405 of a printed circuit board (PCB) 400 according to an embodiment of the invention. In this embodiment, the connector is an edge connector. Separate physical pins (protruding members) are not provided in this embodiment; rather, connections to an electrical source and to a load are provided via the finger contact(s) 405 of the PCB 400. A resistive element 410 operatively coupled to the finger contact (s) 405 prevents or reduces sparking upon initial connection of the connector.

FIG. 4B is a view of an electrical connector implemented as a battery pole connector 412 configured to connect with an uninterruptible power supply 413 according to an embodiment of the invention. A resistive element 420 on one or both elements 414, 416 of the battery pole connector 412 prevents or reduces sparking upon initial connection.

Figure 4C:
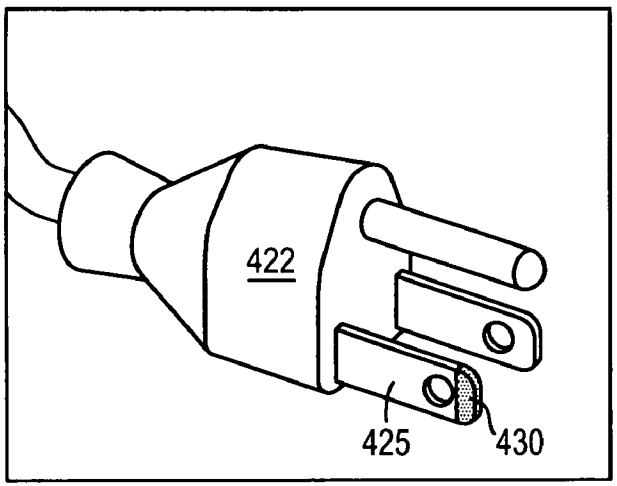

FIG. 4C is a view of an electrical connector implemented as an electrical plug 422 according to an embodiment of the invention. A resistive element 430, e.g., a resistive coating on a pin 425 of the plug 422, prevents or reduces sparking upon initial connection.

Figure 4D:
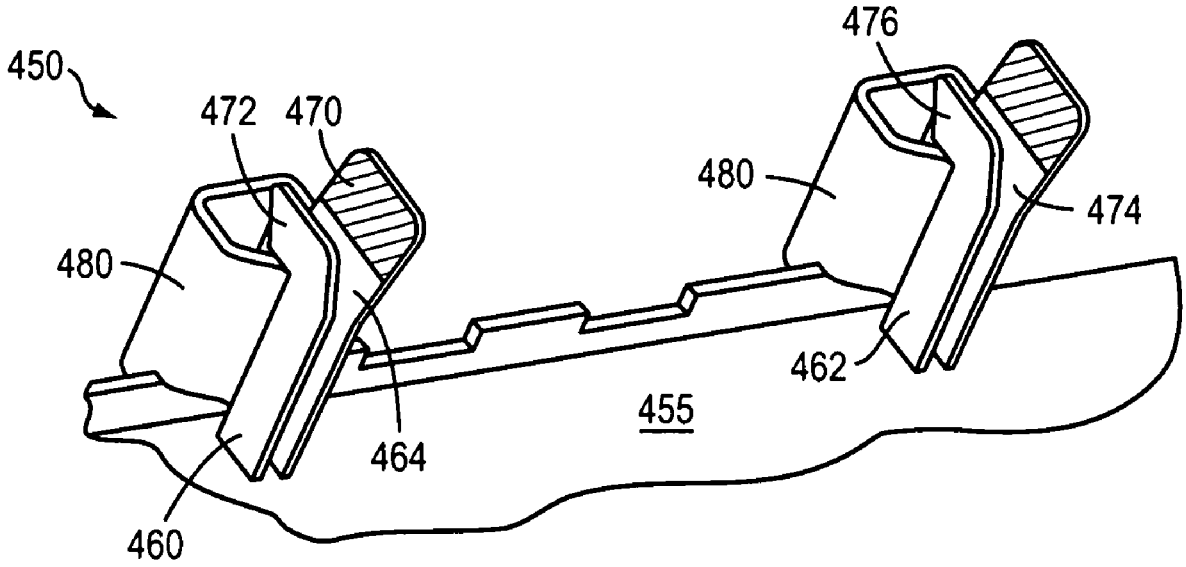

FIG. 4D is a view of an electrical connector implemented as a busbar connector 450 according to an embodiment of the invention. A connector 450 includes a busbar 455, which may be a conductive strip of metal (e.g., copper), and at least two interface components 460, 462 configured to receive an electrical source and a load (not shown), respectively (or vice-versa). Interface component 460 may be conductive (e.g., metallic) and may have slats 470, 472 that give the interface component 460 a "Y" shape, and interface component 462 may be similarly configured with corresponding slats 474, 476. A resistive element 470 is operatively coupled to at least one of the interface components 460, 462 (possibly both, as shown in FIG. 4D), so that flow of electricity is impeded during a state of partial connection due to sole contact with the resistive element 470. During a state of full connection, electrical flow is conducted normally (freely) between the electrical source and the load via the busbar 455. The interface components 460, 462 may be fastened (or otherwise electrically coupled) to the busbar 455 using fasteners 480 or other conventional fastening/coupling techniques. The connector 450 may use other types of interface components than Y-shaped components that are attached to the busbar 455.

Figure 5:
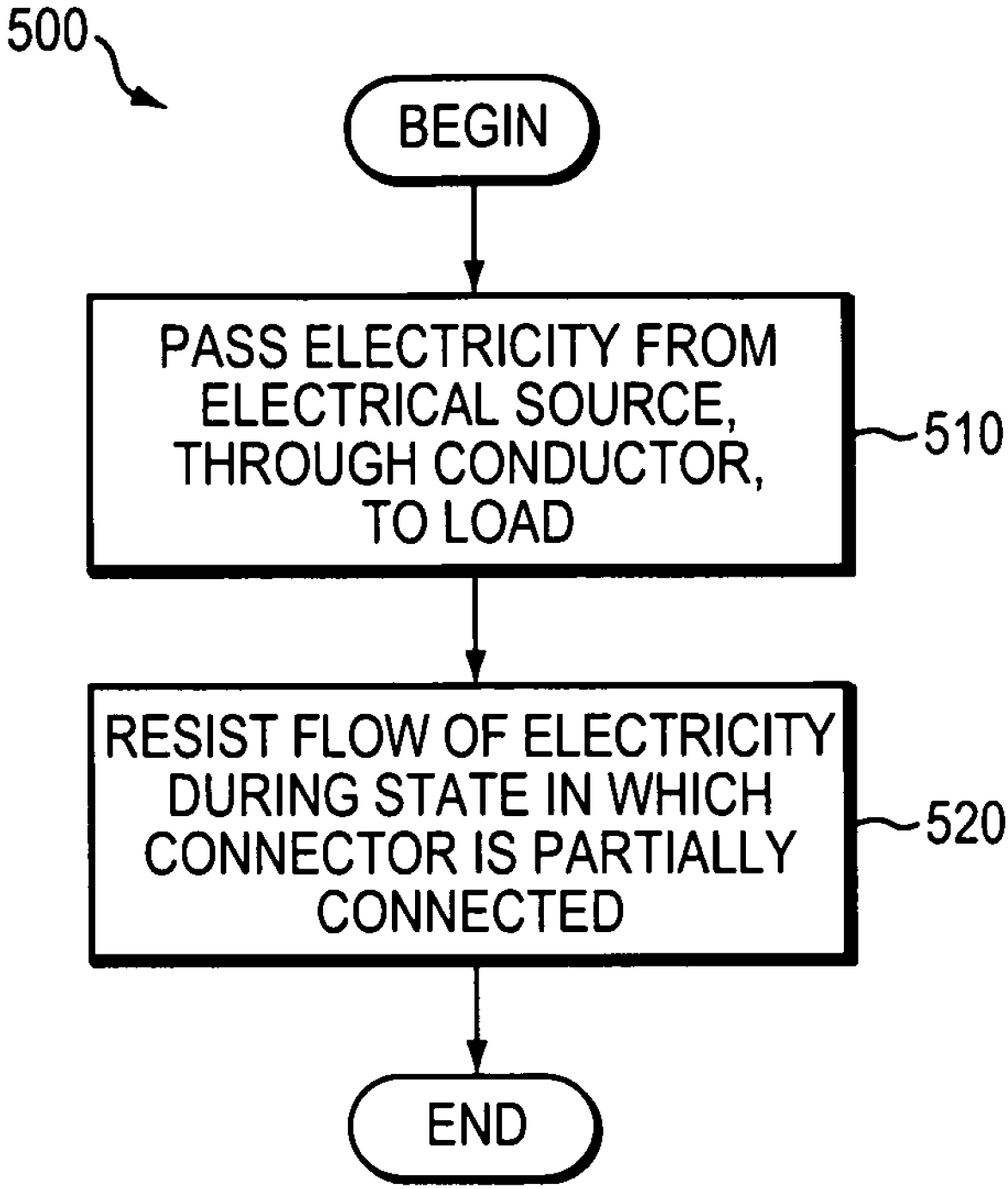
FIG. 5 is a flow diagram of an embodiment of the invention.

FIG. 5 is a flow diagram 500 of an embodiment of the invention. After flow diagram 500 begins, electricity is passed from an electrical source, through a conductor of a connector, to a load (510). The flow of electricity is resisted during a state in which the connector is at least partially connected, e.g., to terminals of an electrical source and/or load (520). It should be understood that the term "partially connected" is broadly used herein and includes a state in which conductive elements of a connector, which mate to enable current to flow therethrough, are close enough in distance that a spark would occur but for the resistive element.

A sparkless electrical connector as in embodiments of the invention is simpler, less expensive, has a lower rate of failure, and is easier to manufacture than prior art sparkless connectors. Manufacturers as well as consumers benefit from these advantages, and users are protected from dangerous sparks.

While this invention has been particularly shown and described with references to example embodiments thereof, it will be understood by those skilled in the art that various changes in form and details may be made therein without departing from the scope of the invention encompassed by the appended claims.

What is claimed is:

1. An electrical connector comprising:

a conductor configured to provide flow of electricity between an electrical source and a load, the electrical source being a battery; and a resistive element, operatively coupled to the conductor, to resist the flow of electricity during a state in which the connector is at least partially connected to the electrical source or the load, and wherein the resistive element is not in contact with a terminal of the electrical source or the load during a state in which the connector is fully connected to the electrical source or the load, wherein the resistive element is a coating, of an anodized material, on a pin of the conductor, the coating providing a resistance sufficient to prevent sparking during connection of the conductor and at least one of the electrical source and the load.

2. The electrical connector of claim 1, wherein the conductor further includes:

a first pin configured to couple electrically with the electrical source; and a second pin configured to couple electrically with the load, the second pin electrically coupled to the first pin; and wherein the resistive element is operatively coupled to at least one of the pins.

3. The electrical connector of claim 1, wherein the conductor includes a busbar and at least two interface components, and further wherein the resistive element is operatively coupled to at least one of the interface components.

4. The electrical connector of claim 1, wherein the coating is at a distal half of the pin.

5. The electrical connector of claim 1, wherein the coating covers a distal tip of the pin.

6. A method of supporting an electrical connection, the method comprising:

passing electricity from an electrical source, through a conductor of an electrical connector, to a load, the electrical source being a battery;

resisting flow of electricity at the electrical connector during a state in which the electrical connector is at least partially connected to the electrical source or the load, wherein resisting the flow of electricity includes providing an anodized coating on the connector to contact a terminal of the electrical source or the load, the coating providing a resistance sufficient to prevent sparking during connection of the conductor and at least one of the electrical source and the load; and supporting normal flow of electricity at the electrical connector during a state in which the electrical connector is fully connected to the electrical source or the load by preventing contact of a resistive element with a terminal of the electrical source or the load.

7. The method of claim 6, wherein the coating covers a distal tip of the connector.

* * * * *